US008246309B2

(12) United States Patent
Le Hong

(10) Patent No.: US 8,246,309 B2
(45) Date of Patent: Aug. 21, 2012

(54) ROTOR DISK FOR TURBOMACHINE FAN

(75) Inventor: Son Le Hong, Thomery (FR)

(73) Assignee: Snecma, Paris (FR)

( * ) Notice: Subject to any disclaimer, the term of this patent is extended or adjusted under 35 U.S.C. 154(b) by 921 days.

(21) Appl. No.: 12/016,517

(22) Filed: Jan. 18, 2008

(65) Prior Publication Data

US 2008/0298972 A1 Dec. 4, 2008

(30) Foreign Application Priority Data

Jan. 18, 2007 (FR) ..... 07 00326

(51) Int. Cl.
*B64C 11/04* (2006.01)

(52) U.S. Cl. ..... 416/220 R

(58) Field of Classification Search ..... 416/219 R, 416/220 R, 221
See application file for complete search history.

(56) References Cited

U.S. PATENT DOCUMENTS

| | | | | |
|---|---|---|---|---|
| 2,965,355 | A * | 12/1960 | Spaeth | 416/2 |
| 4,474,535 | A * | 10/1984 | Dhuic | 416/221 |
| 5,281,098 | A * | 1/1994 | Glynn et al. | 416/221 |
| 5,443,365 | A | 8/1995 | Ingling et al. | |
| 6,065,938 | A * | 5/2000 | Bartsch | 416/219 R |
| 6,183,202 | B1 * | 2/2001 | Ganshaw | 416/219 R |
| 6,481,971 | B1 * | 11/2002 | Forrester | 416/221 |
| 6,634,863 | B1 | 10/2003 | Forrester et al. | |
| 7,207,776 | B2 * | 4/2007 | Townes et al. | 416/95 |
| 2001/0007633 | A1 | 7/2001 | Brioude et al. | |

FOREIGN PATENT DOCUMENTS

| | | | |
|---|---|---|---|
| DE | 10 2005 008 509 | A1 | 9/2005 |
| EP | 1 703 079 | A1 | 9/2006 |
| GB | 2 100 808 | A | 1/1983 |
| GB | 2 380 770 | A | 4/2003 |
| WO | WO 97/49921 | | 12/1997 |

* cited by examiner

*Primary Examiner* — Edward Look
*Assistant Examiner* — Andrew C Knopp
(74) *Attorney, Agent, or Firm* — Oblon, Spivak, McClelland, Maier & Neustadt, L.L.P.

(57) ABSTRACT

A rotor disk for a fan in a turbomachine is disclosed. The disk includes in its perimeter a plurality of essentially axial grooves for the installation and retention of vane roots having hooks at their downstream ends, and deformable regions formed by cavities being situated at the downstream end of the grooves in attachment flanges for inter-vane platforms to absorb the stresses between the disk and the vane roots.

5 Claims, 2 Drawing Sheets

ROTOR DISK FOR TURBOMACHINE FAN

This invention relates to a rotor disk for a turbomachine fan, such as in an aircraft turbojet in particular.

BACKGROUND OF THE INVENTION

In the prior art, a fan rotor disk comprises a plurality of vanes mounted around its perimeter and separated from each other by platforms fixed to disk flanges. Each vane is made up of a blade connected to a vane root by an intermediate section. The vane roots are engaged in grooves formed essentially axially in the perimeter of the disk and are held in these radially by the interlocking of their shapes, the vane roots being for example dovetailed or the like in transverse section.

When the turbomachine is operating, loss of the connection of a vane to the disk can result in the destruction of the neighboring vanes and associated platforms. What happens is that if a fan vane is lost, it pushes against the neighboring vane, and the resulting force applied to this vane causes in particular an axial stress directed in the upstream direction because of the angular setting of the blade relative to the groove, which tends to make the vane twist upstream and generate a large stress in the rear connection between the vane root and the disk. The vane root or a tooth of the disk may then break, causing a chain reaction which can destroy all the vanes of the fan as well as the platforms and seriously damage the turbomachine.

In certain types of vane, the vane root, which is engaged in the groove, is connected downstream to a hook. Recesses formed radially on either side of each hook engage with an annular plate so as to keep the vanes in the axial position when positioned in the grooves of the disk. In the event of loss of a vane, this fixing method generates a large stress in the connecting region between the intermediate section and the hook and in the connection between the recess and the hook. As before, this stress can result in a breakage, at the vane hook or in the disk, and can cause a chain destruction of the vanes and platforms.

In the prior art, an axial groove of approximately 10 mm length, leading to the recess, is machined on each side of the vane root, to limit the stress applied to the intermediate section/hook connecting region and to the recess/hook connecting region, by directing the forces upstream of the machined notch. Although this groove limits the forces at the hook, its disadvantage is that it generates a stress peak at its upstream end, resulting in serious wear of the vane root and of the disk and thus limiting their life. A number of solutions have been envisioned to limit the wear of these parts and have involved removing material at the upstream end of the machined notch, or fitting a shim between the vane and the disk. However, these means do not satisfactorily resolve the problem of wear by limiting the stress applied to the vane hook and transmitted to the platforms.

It is a particular object of the invention to provide a simple, inexpensive and effective solution to these various problems.

SUMMARY OF THE INVENTION

To this end, the invention provides a rotor disk for a fan in a turbomachine, comprising in its perimeter a plurality of essentially axial grooves for the installation and retention of vane roots having hooks at their downstream ends, deformable regions formed by cavities being situated at the downstream end of the grooves, in which disk the cavities are formed in attachment flanges for inter-vane platforms.

In the event of loss of a vane, the stresses exerted by the vane roots on the disk are greatest at the downstream end of the disk and cause local plastic deformation of the cavities of the attachment flanges of the inter-vane platforms, which limits the stress applied to the disk and to the inter-vane platforms. The vanes and platforms can thus be retained in position until the engine is brought to a stop, thus avoiding serious damage to the turbomachine.

The vanes of the rotor disk according to the invention no longer require axial machining to divert the forces. This eliminates the phenomena of disk and vane wear due to this machining while also limiting the stresses applied to the hooks and transmitted to the platforms, because of the cavities formed in the attachment flanges of the inter-vane platforms.

In accordance with another feature of the invention, the cavities are machined out.

The cavities are advantageously oriented axially and are tubular with closed bottoms.

In one embodiment of the invention, the cavities are formed by drilling or milling.

In another variant of the invention, the cavities are open at the sides and lead into the grooves.

The invention also relates to a turbomachine, such as an aircraft turbojet, comprising a fan rotor disk of the type described above.

BRIEF DESCRIPTION OF THE DRAWINGS

Other advantages and features of the invention will be made clear by the following description offered as a non-restrictive example with reference to the appended drawings, in which.

DESCRIPTION OF THE PREFERRED EMBODIMENTS

Figure 1:
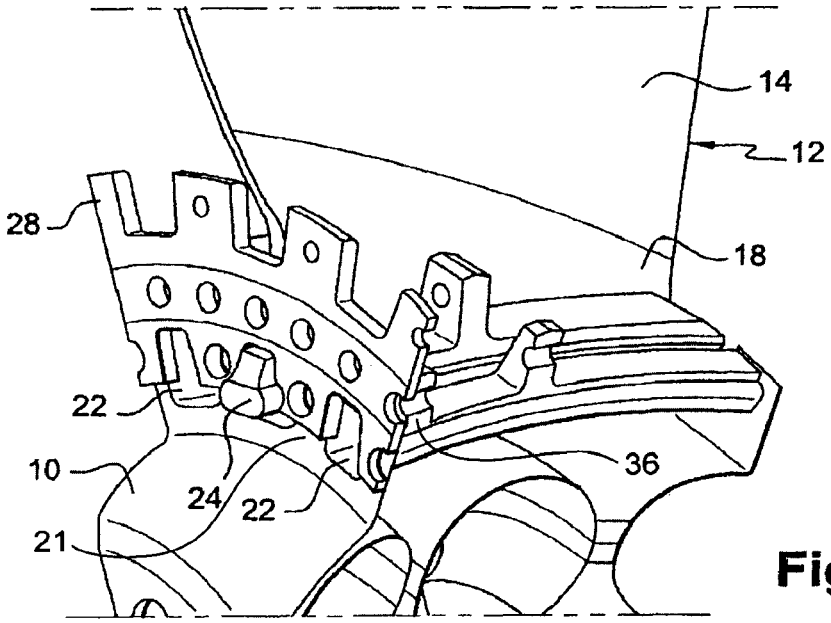
FIG. 1 is a partial perspective view of a disk according to the invention.
Figure 2:
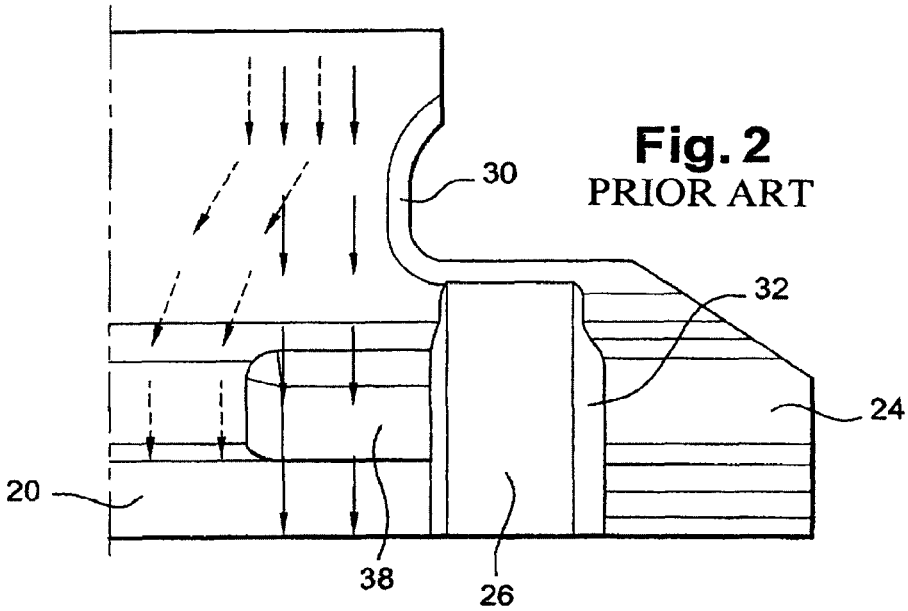
Fig. 2 PRIOR ART
FIG. 2 is a perspective view of the downstream part of a fan vane root according to the prior art.

Referring initially to FIG. 1, this shows a fan disk 10 carrying a vane 12, while FIG. 2 shows the radially inward downstream part of a prior-art vane.

A vane is made up of a blade 14 connected to a vane root 20 via an intermediate section 18. The disk 10 comprises a plurality of essentially alternating axial ribs 21 and grooves 22 distributed regularly around its outer perimeter, the vanes 12 being engaged in the grooves 22. Platforms (not shown) are arranged between the vanes and serve to orient the airstream entering the turbomachine. The vane root 20, of dovetail or similar shape, engages with the groove 22 for the radial retention of the vane (12) on the rotor disk 10. In the downstream continuation of the vane root 20 of the disk 10 there is formed a hook 24 comprising a radial recess 26 on each of its lateral faces. These recesses engage with an annular plate 28 to lock the root 20 of the vane 12 axially in the groove 22 of the disk 10.

When the turbomachine is operating, the intermediate section/hook connecting region 30 and the recess/hook connecting region 32 are highly stressed. If a vane is lost, the radial contact of the vane detached from the disk with the neighboring vane produces, owing to the mounting of the vane in a groove, an additional stress in the intermediate section/hook connecting region 30 and the recess/hook connecting region 32. As a result, the stress applied to the rear of the vane weakens and can break the hook 24. Such a stress can also damage the disk and therefore the inter-vane platforms fixed to it. The loss of the connection with the disk of a second vane can produce a chain reaction leading to the total destruction of the fan vanes and associated platforms, resulting in major damage to the turbomachine. It is therefore vital to keep the vanes in position in their grooves and the platforms on the disk attachment flanges in the event of loss of vanes.

In the prior art, shown in FIG. 2, an axial notch 38 is machined out on each side of the hook 24, entering from the recess 26. The axial notch 38 diverts the loads, as shown in dashed arrows, away from the notch, thus reducing the stresses applied to the hook (the forces that would occur in the absence of the notch are shown in solid arrows). The stresses applied to the hook are thus limited and the vane behaves better. However, this type of solution is not satisfactory because a large stress is generated at the upstream end of the notch 38, which causes serious wear of the vane root and of the disk.

To overcome this phenomenon of wear and yet limit the stress which is applied to the vane/disk connection and transmitted to the platforms, the invention provides for the formation in the disk 10 of deformable regions 34 situated at a greater radial distance than the grooves 22, at the hooks of the vane roots.

Figure 3:
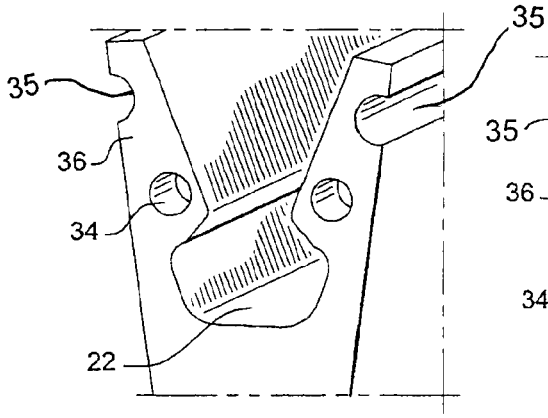
FIG. 3 is a schematic perspective view of a first embodiment of a rotor disk according to the invention.
Figure 4:
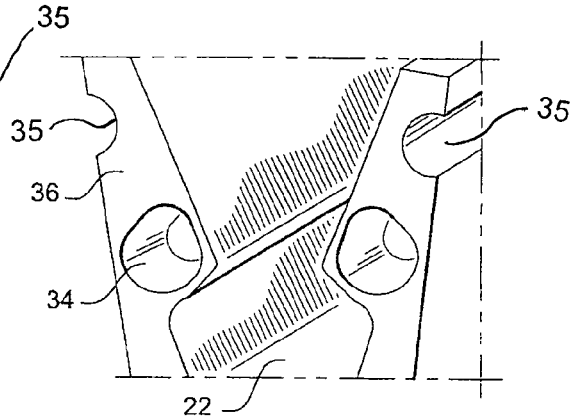
FIG. 4 is a schematic perspective view of a second embodiment of a rotor disk according to the invention.
Figure 5:
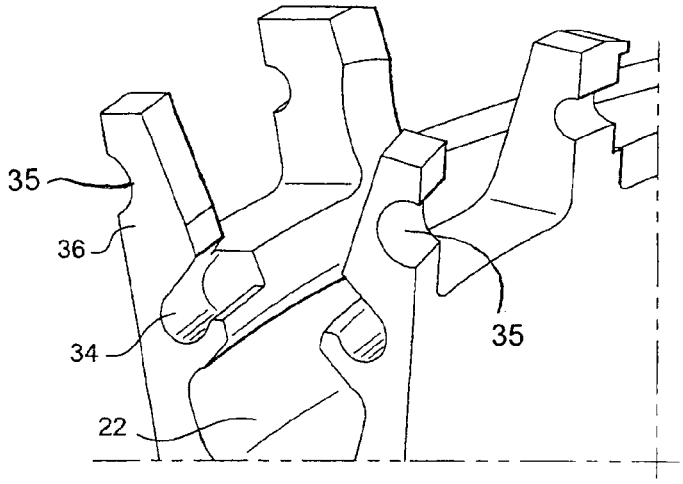
FIG. 5 is a schematic perspective view of a third embodiment of a rotor disk according to the invention.

As shown in FIGS. 3, 4 and 5, deformable regions 34 are formed by cavities 34 formed in attachment flanges 36 of inter-vane platforms (not shown), and are fixed to flanges 36 extending generally in line with the side walls of the grooves 22 (FIGS. 3-5). Additionally, a hole 35 is disposed radially outward of the cavities.

FIGS. 3 and 4 show two initial embodiments of the invention in which the cavities 34 are oriented axially and are tubular with closed bottoms.

In a third embodiment of the invention, shown in FIG. 5, the cavities 34 are open at the sides and lead into the grooves.

In these different embodiments, the diameter of the cavity may be for example around 6 to 9 mm, the wall thickness of the cavity is between 0 and 3 mm, and the depth approximately 20 mm. These values are given as a guide for a rotor disk 10 with an external diameter of around 200 mm.

These cavities may be produced by quick and simple machining techniques such as drilling or milling.

The incorporation of cavities 34 into the attachment flanges 36 of the inter-vane platforms allows the cavities to deform plastically in the event of loss of a vane. Vane bearing extraction forces are oriented towards the cavities 34. The stress applied to the rear hook is thus reduced, preventing breakage of the hook and allowing the vane to stay in position in its groove and allowing the associated platforms to remain fixed to the flanges 36 of the disk 10 until the turbomachine comes to a stop. Moreover, in normal operation, the life is no longer limited by the wear due to axial machining in the vane root 20, since this is no longer necessary.

Although the invention described above is particularly beneficial in the case of a combined use with vanes 12 with hooks 24, it is nonetheless not limited to this type of application and can be used with all other types of fan vanes 12.

The invention claimed is:

1. A turbomachine comprising:

a rotor disk for a fan including, in a perimeter thereof, a plurality of essentially alternating axial ribs and grooves;

vane roots being axially engaged and radially retained within the grooves of the disk, each of the vane roots including a hook disposed at a downstream end thereof; and deformable regions formed by cavities being situated at a downstream end of the disk, wherein the cavities are formed in attachment flanges for inter-vane platforms, the flanges extending outwardly of the grooves and in line with the ribs of the disk, the cavities being oriented axially and tubular with closed bottoms.

2. The turbomachine as claimed in claim 1, wherein the cavities are open at sides thereof and lead into the grooves.

3. The turbomachine as claimed in claim 1, wherein the hooks at the downstream ends of the vane roots cooperate with an annular plate mounted on a downstream end of the disk so as to lock the vane roots axially in the grooves of the disk.

4. The turbomachine as claimed in claim 1, wherein each of the attachment flanges includes a hole disposed radially outward of the cavities.

5. The turbomachine as claimed in claim 1, wherein each hook of the vane roots is open radially outwardly.

* * * * *